United States Patent [19]

Sayre

[11] Patent Number: 4,778,205

[45] Date of Patent: Oct. 18, 1988

[54] PRECISION LATCH ASSEMBLY HAVING MEANS FOR RESTRICTING PIN MOVEMENT IN THREE DEGREES OF FREEDOM

[75] Inventor: James L. Sayre, San Jose, Calif.

[73] Assignee: Kaiser Electronics, San Jose, Calif.

[21] Appl. No.: 89,478

[22] Filed: Aug. 26, 1987

[51] Int. Cl.[4] ..... E05C 1/16

[52] U.S. Cl. ..... 292/171; 292/302

[58] Field of Search ..... 292/106, 150, 171, 302, 292/163, 175

[56] References Cited

U.S. PATENT DOCUMENTS

| | | | |
|---|---|---|---|
| 1,151,889 | 8/1915 | Lydecker | 292/277 |
| 1,177,446 | 3/1916 | Rains . | |
| 1,609,772 | 12/1926 | Rank . | |
| 1,630,913 | 5/1927 | Wiley . | |
| 1,678,982 | 7/1928 | Griffin . | |
| 1,720,593 | 7/1929 | Geiser . | |
| 1,903,782 | 4/1933 | Eyring | 292/175 |
| 1,956,873 | 5/1934 | Mustin | 27/35 |
| 2,074,501 | 3/1937 | Cline | 292/60 |
| 2,477,524 | 7/1949 | Oswald et al. | 292/175 |
| 2,629,246 | 2/1953 | Schumann | 292/DIG. 65 X |
| 3,233,932 | 2/1966 | Utterback | 292/175 |
| 3,406,995 | 10/1968 | McCarthy | 292/173 X |
| 3,498,658 | 3/1970 | Steenstra et al. | 292/171 X |
| 3,994,543 | 11/1976 | Melugin | 292/302 X |
| 4,691,948 | 9/1987 | Austin, Jr. et al. | 292/171 |

*Primary Examiner*—Richard E. Moore

*Attorney, Agent, or Firm*—Townsend & Townsend

[57] ABSTRACT

An improved latch assembly having a latch body adapted to be coupled to a generally fixed support, such as a chassis unit, wall or post. The latch body has a groove for removably receiving a retained pin which is adapted to be mounted on a movable structural member to be latched, such as a door, support arm, gate or the like. The latch body further includes a latch pin which is spring biased into engagement with the retained pin when the retained pin is received in the groove of the latch body. The inter-engagement of the retained pin and latch pin is such that the retained pin is restricted against movement in three mutually perpendicular directions, namely the x, y and z directions. The retained pin has a pair of spaced, cylindrical parts on opposite sides of a pair of beveled parts which converge toward each other to an annular junction therebetween. The latch pin has a conical end portion for engaging the beveled parts of the retained pin to resist axial movement of the retained pin in the z direction. The engagement of the cylindrical parts of the retained pin with the surfaces of the latch body defining the groove resists movement of the retained pin in a pair of mutually perpendicular directions, namely the x and y directions.

13 Claims, 2 Drawing Sheets

PRECISION LATCH ASSEMBLY HAVING MEANS FOR RESTRICTING PIN MOVEMENT IN THREE DEGREES OF FREEDOM

This invention relates to improvements in latches of the type for releasably coupling doors, support arms and the like to fixed supports, such as cabinets, chassis units and walls. More particularly, this invention relates to an improved latch assembly having a retained pin which, when latched, is accurately located and restricted against movement in three mutually perpendicular directions.

BACKGROUND OF THE INVENTION

Latch assemblies for doors, gates and the like are well-known and have been used for many years. Typically, a conventional latch includes a pin and some type of retainer which allows the pin to be moved into and out of an operative, latched position so that, when the pin is on a door or the like, the door can be held in a closed or other position. Generally, latches of conventional construction prevent movement of a latch pin in, at most, only two degrees of freedom. While such latch assemblies are satisfactory for certain applications, they sometimes are not adequate to accurately position and restrict all movement of a retained pin, especially in situations where the latch assembly is subject to considerable vibration, such as in a vehicle or in a plant or laboratory where motors, generators, weapon firing and the like give rise to major vibratory modes in the vicinity in which the latch assembly is used.

Because of the limitations of conventional latch assemblies, a need exists for improvements in such assemblies which, when used, resist essentially all movements which might occur due to the effects of vibration and rough handling or otherwise. The present invention satisfies this need.

Prior U.S. patents relating to latches having shiftable pins include the following:

U.S. Pat. No. 1,177,446
U.S. Pat. No. 1,609,772
U.S. Pat. No. 1,630,913
U.S. Pat. No. 1,678,982
U.S. Pat. No. 1,720,593
U.S. Pat. No. 1,903,782
U.S. Pat. No. 1,956,873
U.S. Pat. No. 2,074,501
U.S. Pat. No. 2,477,524
U.S. Pat. No. 3,233,932

SUMMARY OF THE INVENTION

The present invention is directed to an improved latch assembly having a latch body adapted to be coupled to a generally fixed support, such as a wall, a chassis unit or post. The latch body has a groove for removably receiving a retained pin which is adapted to be mounted on a movable structural member to be latched, such as a support arm, door, gate or the like. The latch body further includes a latch pin which is spring biased into engagement with the retained pin when the retained pin is received in the groove of the latch body. The inter-engagement of the retained pin and latch pin is such that the retained pin is restricted against movement in three mutually perpendicular directions, namely the x, y and z direction, assuming that the z direction is along the axis of the retained pin. Thus, the latch pin, when engaging the retained pin, resists the loosening effects of vibration and any other tendency for the retained pin to move away from the groove of the latch body. Moreover, since the latch pin is spring biased into an operative position in engagement with the retained pin, a simple linear movement of the latch pin serves to move the latch pin out of engagement with the retained pin to thereby allow release of the retained pin from the groove and movement of the retained pin away from the latch body itself.

In a preferred embodiment of the invention, the retained pin has a pair of spaced cylindrical parts on opposite sides of a pair of beveled parts which converge toward each other to an annular junction therebetween. The latch pin has a conical end portion for engaging the tapered central parts of the retained pin to resist axial movement of the retained pin in the z direction. The engagement of the cylindrical part of the retained pin with the surfaces of the latch body defining the groove resists movement of the retained pin in a pair of mutually perpendicular directions, namely the x and y directions. Thus, the retained pin is restricted against movement in any direction once the latch pin, in its operative position, engages the retained pin. In the event the retained pin is subjected to a large external force and thus moved out of the retained position, the action of the spring-loaded latch pin against the retained pin will return the retained pin to its retained position.

The primary object of the present invention is to provide an improved latch assembly which has parts which engage a retained pin so that the retained pin will be restricted against movement in three mutually perpendicular directions to thereby permit the latch assembly to be used in applications where no motion of the retained pin can be tolerated.

Another object of the present invention is to provide a latch assembly of the type described in which the retained pin and the latch pin are configured to provide contact points between the two pins and between the retained pin and the surfaces defining a pinreceiving groove so that the contact points restrict the movement of the retained pin to thereby simplify the construction of the latch assembly and to minimize the cost of producing and maintaining the latch assembly.

Other objects of this invention will become apparent as the following specification progresses, reference being made to the accompanying drawings for an illustration of the invention.

IN THE DRAWINGS

Figure 1:
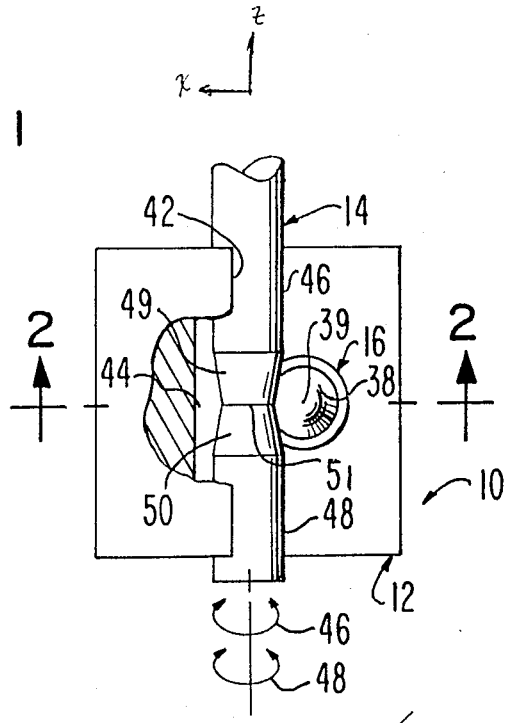
FIG. 1 is a top plan view, partly broken away and in section of the latch assembly of the present invention.

The latch assembly of the present invention is broadly denoted by the numeral 10 and includes a latch body 12, a retained pin 14 and a latch pin 16, all which cooperate with each other to releasably hold retained pin 14 in a position shown in FIGS. 1–4. Retained pin 14 may be coupled to any suitable structure, such as a swinging door of a cabinet, which door is to be releasably held, for instance, in a closed condition when retained pin 14 is in the position shown in FIG. 1.

Latch body 12 is adapted to be mounted in any suitable manner to a fixed support. Latch body 12 includes an upright body 18 (FIG. 2) with a pair of laterally extending parts 20 and 22 integral with body 18. Parts 20 and 22 have holes 24 and 26 therethrough, respectively, and these holes have bushings 28 and 30 therein to slideably mount latch pin 16 in the manner shown in FIG. 2.

The upper segment 32 of latch pin 16 has a greater diameter than the major portion of the latch pin to present a shoulder 34 for engaging a washer 36. A coil spring 37 extending between washer 36 and the upper part of bushing 30 biases latch pin upwardly so that the upper, conical tip 38 of latch pin 36 will be biased into its operative position shown in FIG. 4. The upper, conical tip 38 has a dome-shaped top 39. This shape is provided to facilitate the engagement of latch pin 16 with retained pin 14.

Figure 2:
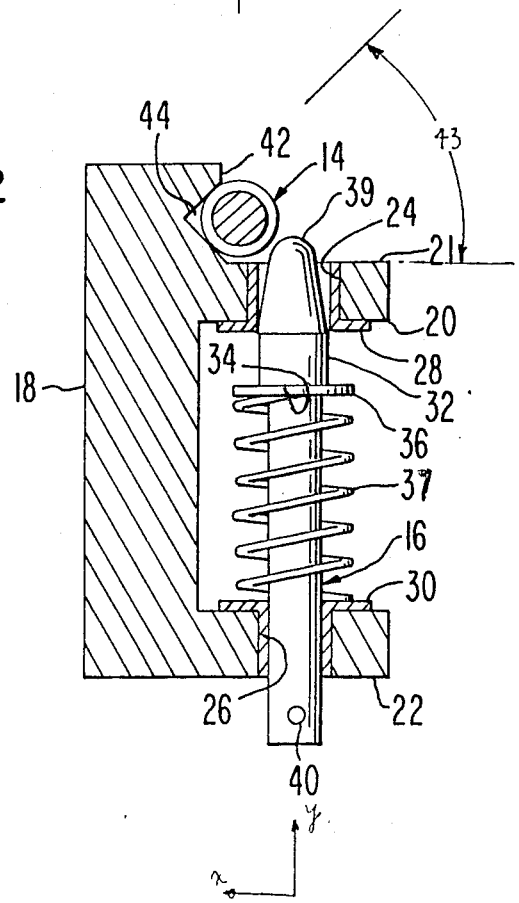
FIG. 2 is a cross-sectional view of taken along line 2—2 of FIG. 1.
Figure 4:
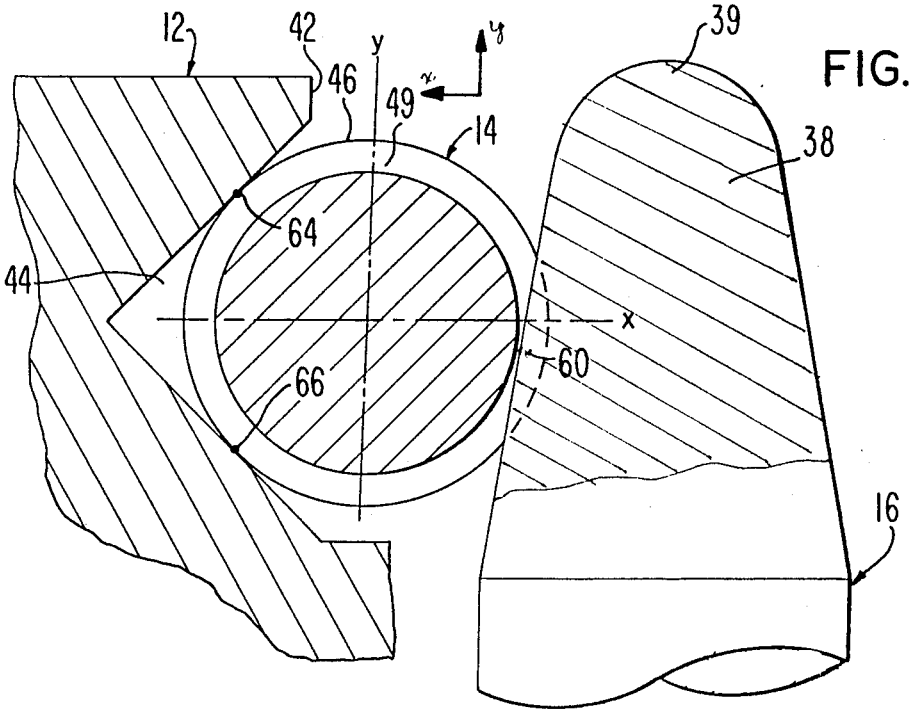
FIG. 4 is an enlarged, fragmentary, cross-sectional view of the latch assembly taken along line 4—4 of FIG. 3, showing the contact points of FIG. 3 from a different location.

An upper side face 42 of latch assembly body 18 has a groove 44 therein which is transversely V-shaped as shown in FIGS. 2 and 4. This groove is adapted to removably receive the cylindrical parts 46 and 48 of retained pin 14 when the structure on which retained pin 14 is coupled is moved in a direction such that pin 14 moves to the left in FIG. 1. Pin 14 has a pair of conical surfaces 49 and 50 which converge toward each other so as to form an annular junction 51.

In use, pin 14 is coupled to some suitable structure, such as a swinging door, and the latch pin 16 typically is in a position blocking the entry of the pin into groove 44 of latch body 12. When it is desired to latch retained pin 14, latch pin 16 is pulled downwardly when viewing FIG. 2 so that upper, dome shaped top 39 is pulled flush or below the upper surface 21 of lateral part 20 of body 18. Then, retained pin 14 is shifted into the position shown in FIGS. 1–4 with the cylindrical parts 46 and 48 engaging the surfaces defining the groove 44. Arrow 43 (FIG. 2) shows the allowable entrance and exit arc of retained pin 14.

Pin 16 is released and spring 38 causes the pin to move into its locked position shown in FIG. 4. When so positioned, latch pin 16 releasably locks retained pin 14 in groove 44 and the retained pin is centered in groove 44.

Figure 3:
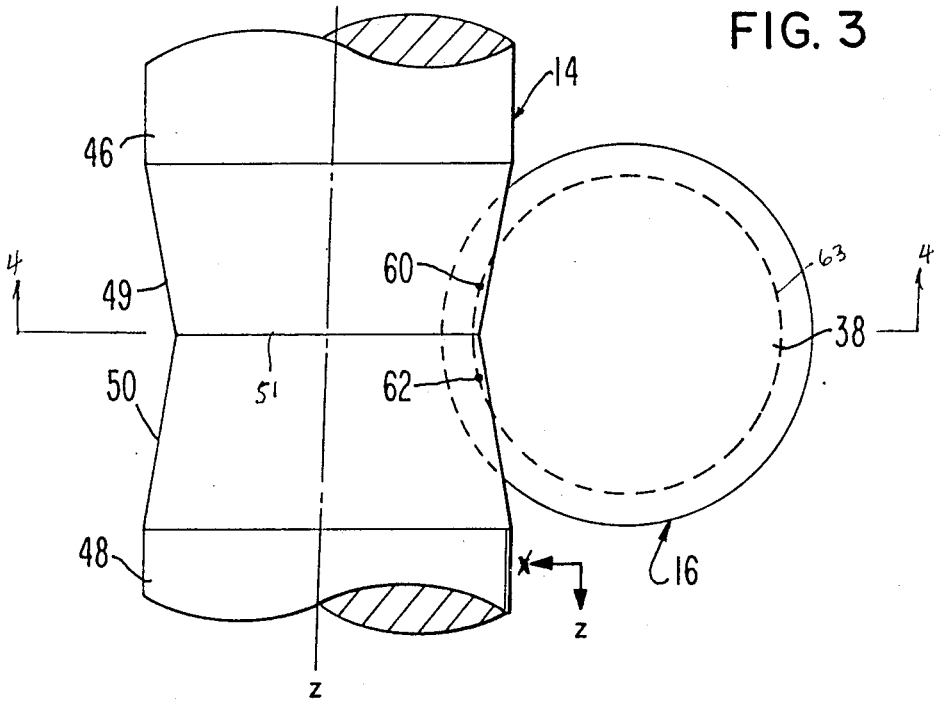
FIG. 3 is an enlarged, fragmentary top plan view of the latch assembly, showing the way in which the latch pin contacts the retainer pin of the latch assembly.

FIG. 3 shows points 60 and 62 being the contact points between conical tip 38 and concial surfaces 49 and 50, which resist motion of pin 14 in the z direction, namely the direction axially of retained pin 14. These contact points lie on imaginary diameter 63 on conical part 38. Points 64 and 66 (FIG. 4) are the contact points at which the cylindrical parts 46 and 48 of retained pin 14 engage the surfaces defining groove 44. These points 64 and 66 are points of tangency which resist the movement in the x and y directions as indicated in FIG. 4. Point 60 is also shown in FIG. 4 and the engagement of tip 38 of the latch pin 16 with the surface 49 assures that there will be no x, y and z movements of the retained pin 14 relative to latch pin 16.

In addition, if retained pin 14 is displaced in the Z axis, an increased force on the contact point 60 or 62 will, by application of that force exerted through the contact point onto the conical surface 49 or 50, respectively, tend to return pin 14 to its locked position.

When it is desired to release retained pin 14, latch pin 16 is pulled downwardly when viewing FIG. 2 to clear the upper surface 21 of lateral part 20 of body 18. This allows retained pin 14 to move to the right when viewing FIGS. 1 and 2. Thereupon, latch pin 16 can then be released again.

Hole 40 in latch pin 16 may serve as an attach point for a tension member, such as a rod or cable, to allow remote operation of latch assembly 10.

I claim:

1. A latch assembly comprising: a latch body having a groove; a latch pin shiftably mounted on the body for movement into and out of an operative position with respect thereto; and a retained pin moveable relative to the latch body into and out of the groove, said retained pin being held in the groove when the latch pin is in its operative position, the retained pin having angled surface means engageable with the latch pin to hold the retained pin against movement in three mutually perpendicular directions when the retained pin is in the groove and when the latch pin is in said operative position.

2. A latch assembly as set forth in claim 1, wherein is included means biasing the latch pin into its operative position.

3. A latch assembly as set forth in claim 2, wherein the bias means includes a coil spring surrounding the latch pin.

4. A latch assembly as set forth in claim 1, wherein the latch pin has a conical end portion, said surface means including a pair of relatively angularly disposed surfaces for making two point contacts with the conical portion of the latch pin to prevent axial movement of the retained pin when the retained pin is in the groove and when the latch pin is in its operative position.

5. A latch assembly as set forth in claim 1, where the latch pin has an annular shoulder spaced from one end thereof, there being a coil spring surrounding the latch pin and engaging the shoulder and the latch body to bias the latch pin toward its operative position.

6. A latch assembly as set forth in claim 1, wherein the latch body includes a pair of spaced lateral parts, said parts having respective aligned holes, said latch pin being shiftably mounted on the latch body and extending through the holes, and a coil spring surrounding the latch pin for biasing the latter into its operative position.

7. A latch assembly as set forth in claim 1, wherein the retained pin includes a pair of tapered surfaces, said latch pin being in point contact with the tapered surfaces when the retained pin is in the groove and when the latch pin is in its operative position.

8. A latch assembly as set forth in claim 7, wherein the tapered surfaces are conical and are joined together at a common junction therebetween, the retained pin having its smallest transverse dimension at said junction.

9. A latch assembly as set forth in claim 1, wherein the retained pin has a pair of cylindrical parts for engaging the surfaces of the latched body defining the groove, and a pair of conical, tapered parts between the cylindrical part for engagement with the latch pin, the engagement of the cylindrical parts of the retained pin with the latch body being sufficient to prevent movement of the retained pin in first and second mutually perpendicular directions when the retained pin is in the groove, and the engagement of the tapered surfaces with the latch pin being sufficient to prevent movement of the retained pin in a third direction mutually perpendicular to the first and second directions when the retained pin is in the groove.

10. A latch pin as set forth in claim 9, wherein the groove is transversly V-shaped.

11. A latch assembly as set forth in claim 10, wherein the latch pin has a conical end for engaging the tapered surfaces of the retained pin.

12. A latch assembly comprising: a latch body having a groove; a latch pin; means mounting the latch pin on the latch body for movement into and out of an operative position; and a retained pin moveable into and out of the groove when the latch pin is out of its operative position, said retained pin having a pair of axially spaced cylindrical parts and a pair of adjacent tapered parts between the cylindrical parts, the tapered parts being progressively decreasing in transverse dimension as they approach each other, said retained pin being moveable partially into the groove and said cylindrical parts being engageable with the surface portions of the latch body which define the groove, said latch pin having a conical end for point contact engagement with the tapered parts of the retained pin when the retained pin is in the groove and when the latch pin is in its operative position, whereby the retained pin is restricted against movement axially while the engagement of the cylindrical parts with the latch body in the groove limit the movement of the retained pin in first and second axes mutually perpendicular to the axis of the retained pin.

13. A latch assembly as set forth in claim 12, wherein is included means biasing the latch pin toward its operative position.

* * * * *